US010835099B2

(12) United States Patent
Armellin et al.

(10) Patent No.: US 10,835,099 B2
(45) Date of Patent: Nov. 17, 2020

(54) DISHWASHING MACHINE

(71) Applicant: Electrolux Professional S.p.A., Pordenone (IT)

(72) Inventors: Daniele Armellin, San Quirino (IT); Fabio Massimo Ciappina, Cordenons (IT); Fabio Colonnello, Pordenone (IT); Giuliano Frascati, Cordenons (IT); Sandro Gerotto, Noventa di Piave (IT); Alessandro Molinaro, Sequals (IT); Gianni Moretto, Cordenons (IT); Corrado Pella, Pordenone (IT); Matteo Peruzzo, Grizzo di Montereale Valcellina (IT); Luigi Zilli, Zoppola (IT)

(73) Assignee: Electrolux Professional S.p.A., Pordenone (IT)

( * ) Notice: Subject to any disclaimer, the term of this patent is extended or adjusted under 35 U.S.C. 154(b) by 168 days.

(21) Appl. No.: 15/888,165

(22) Filed: Feb. 5, 2018

(65) Prior Publication Data

US 2018/0242812 A1 Aug. 30, 2018

(30) Foreign Application Priority Data

Feb. 27, 2017 (EP) ..... 17158126

(51) Int. Cl.
*A47L 15/42* (2006.01)
*A47L 15/24* (2006.01)

(52) U.S. Cl.
CPC ..... *A47L 15/4206* (2013.01); *A47L 15/241* (2013.01); *A47L 15/4202* (2013.01); *A47L 15/4204* (2013.01); *A47L 15/4208* (2013.01); *A47L 15/4219* (2013.01); *A47L 15/4225* (2013.01)

(58) Field of Classification Search
CPC combination set(s) only.
See application file for complete search history.

(56) References Cited

U.S. PATENT DOCUMENTS 5,267,580 A * 12/1993 Payzant ..... A47L 15/241 134/108
2009/0001006 A1* 1/2009 Pardini ..... A47L 15/4206 210/195.4
2015/0320288 A1* 11/2015 Anim-Mensah .... A47L 15/4291 134/19

* cited by examiner

*Primary Examiner* — Cristi J Tate-Sims
(74) *Attorney, Agent, or Firm* — Pearne & Gordon LLP

(57) ABSTRACT

Dishwashing machine including an outer casing with an inner washing cavity adapted to accommodating a dishwasher rack. A catchment sink assembly is located on the bottom of the inner washing cavity to collect and accumulate liquid trickling down from the dishwasher rack momentarily located above the catchment sink assembly. The catchment sink assembly includes a basin-shaped catchment tank. A cup-shaped drain sump extends downwards from the bottom of the catchment tank and directly communicates with the inside of the catchment tank to receive washing or rinsing liquid arriving on the bottom of the catchment tank. A tubular member communicates with the catchment tank and is detachably fitted into a corresponding tubular outlet portion in the drain sump to divide the inner volume of the drain sump into a first inner-volume portion directly connected to a water drain line, and a second inner-volume portion directly connected to the suction of the pump.

14 Claims, 8 Drawing Sheets

DISHWASHING MACHINE

The present invention relates to a dishwashing machine.

More specifically, the present invention preferably relates to a rack-type tunnel dishwashing machine, to which the following description will make explicit reference without however losing in generality.

As is known, a rack-type tunnel dishwashing machine basically comprises: a boxlike outer casing provided with a rectilinear, pass-through tunnel extending substantially horizontally within the casing; and a linear conveyor adapted to advance a succession of dishwasher racks along the pass-through tunnel. A washing station and a rinsing station are arranged one downstream the other inside the pass-through tunnel, so as to be crossed in succession by each dishwasher rack travelling inside the pass-through tunnel.

At the washing station, a number of high-pressure jets of hot water at nearly 60° C. mixed with detergent/s are directed towards the dishwasher rack momentarily located at washing station, so as to remove the filth from the dishware in said dishwasher rack.

At the rinsing station, a number of high-pressure jets of hot water at nearly 80° C. mixed with rinse agent/s are directed towards the dishwasher rack momentarily located at rinsing station, so as to remove any residual of detergent/s from the dishware in said dishwasher rack and sanitize the same dishware.

More in detail, both inside the segment of the tunnel corresponding to the washing station and inside the segment of the tunnel corresponding to the rinsing station, the rack-type dishwashing machine basically comprises: a catchment sink assembly which is arranged on the bottom of the tunnel for collecting and accumulating the mixture of water and detergent/s or rinse agent/s trickling down from the dishwasher rack momentarily travelling inside the washing station or the rinsing station; a number of nozzles which are arranged above and beneath the moving path of the dishwasher racks, and are oriented so as to direct the corresponding water jets towards the dishwasher rack momentarily travelling inside the washing station or the rinsing station; a water-circulating pump that sucks the mixture of water and detergent/s or rinse agent/s from the catchment sink assembly and feeds said mixture towards the nozzles with a pressure of usually 2-3 bars; and a filtering device which is located upstream of the suction mouth of the water-circulating pump, and is structured to hold/block foodstuff particulates and other solid contaminants in suspension in the mixture of water and detergent/s or rinse agent/s directed towards the pump.

In today's rack-type tunnel dishwashing machines, in particular, the catchment sink assembly generally includes a large basin-shaped catchment tank and a drain sump located on the bottom of the tank, whereas the water-circulating pump sucks the mixture of water and detergent/s or rinse agent/s from the inside of the drain sump. The filtering device, in turn, basically consists in a cup-shaped body which is fitted into the upper rim of the drain sump to close the drain sump, and has, on the upper dome-shaped portion, a number of pass-through slits which are dimensioned to prevent foodstuff particulates and other solid contaminants in suspension in the mixture of water and detergent/s or rinse agent/s to enter into the drain sump.

Aim of the present invention is to improve filtering capabilities of the filtering device and to furthermore prevent undesired prolonged stagnation of the washing or rinsing water inside the drain sump after emptying of the catchment sink.

In compliance with the above aim, according to the present invention there is provided a dishwashing machine comprising: an outer casing which is provided with an inner washing cavity adapted to accommodate at least one dishwasher rack; a number of nozzles adapted to direct corresponding jets of liquid towards the dishwasher rack momentarily located inside said inner washing cavity; at least one catchment sink assembly which is located on the bottom of said inner washing cavity so as to collect and accumulate the liquid trickling down from the dishwasher rack momentarily located above said catchment sink assembly; and at least one pump that sucks the liquid from said catchment sink assembly and feeds said liquid to the nozzles with a given pressure; said catchment sink assembly comprising: a basin-shaped catchment tank; a drain sump which extends downwards from the bottom of said catchment tank and directly communicates with the inside of the catchment tank so as to receive by gravity the liquid arriving on the bottom of the catchment tank; the dishwashing machine comprising a tubular member which communicates with the catchment tank and is fitted in detachable manner into a corresponding tubular outlet portion formed in the drain sump, so as to divide the inner volume of the drain sump into a first inner-volume portion directly connected to a water drain line of the dishwashing machine, and a second inner-volume portion directly connected to the suction of said pump.

The tubular member creates a direct communication between the internal of the catchment tank and the water drain line, and in this way it facilitates the draining of foodstuff particulates or other solid contaminants in suspension in the liquid present into the catchment tank. On the same time the tubular member delimits a second inner-volume portion by which the internal of the catchment tank is connected to the pump that sucks the liquid from the catchment sink assembly and feeds this liquid to the nozzles; in this way it is ensured that at least a part of the liquid present into the catchment tank is circulated by the pump.

Preferably, the catchment sink assembly includes one or more auxiliary water passages which are formed, at the tubular outlet portion of the drain sump, so as to put said first and second inner-volume portions of the drain sump in fluid communication to one another.

Advantageously, the one or more auxiliary water passages of the catchment sink assembly are at least partly formed in said tubular member.

More preferably, a lower annular rim of said tubular member is provided with one or more slotted indentations which are adapted to form, together with the upper rim of tubular outlet portion of the drain sump, a corresponding number of pass-through openings dimensioned to allow free passage of liquid; each pass-through opening defining a respective auxiliary water passage.

In an advantageous embodiment, the one or more auxiliary water passages are dimensioned to prevent foodstuff particulates or other solid contaminants in suspension in the liquid present into the first inner-volume portion of the drain sump and exceeding a given size, to enter/move into the second inner-volume portion of the drain sump.

In a further advantageous embodiment, the catchment sink assembly comprises a cup-shaped filtering body which is fitted in detachable manner into the drain sump so as to close said drain sump; said cup-shaped filtering body having a substantially dome-shaped, water-permeable upper portion, and an inner tubular segment that protrudes downwards from the dome-shaped upper portion and extends into the drain sump to form said tubular element.

Preferably, the dome-shaped upper portion of said cup-shaped filtering body protrudes inside catchment tank.

In an advantageous embodiment, the catchment sink assembly additionally comprises a plate-like water conveyor which is arranged to close the catchment tank so as to collect the liquid directed to the catchment tank, and which is provided with a main pass-through opening through which said liquid falls into the beneath-located catchment tank.

Preferably, the main pass-through opening of said plate-like water conveyor is substantially vertically aligned to the drain sump.

In an advantageous embodiment, the catchment sink assembly additionally comprises a strainer member which is fitted in removable manner into the main pass-through opening of said plate-like water conveyor, and is structured to hold/block the foodstuff particulates and other solid contaminants in suspension in the liquid passing/flowing through the same strainer member and exceeding a given size.

Preferably, the strainer member partly protrudes underneath the plate-like water conveyor via the main pass-through opening of the same plate-like water conveyor.

More preferably, the strainer member includes a basin-shaped basket having a substantially flat, water-impermeable bottom wall and one or more water-permeable sidewalls structured to hold/block the foodstuff particulates and other solid contaminants in suspension in the liquid arriving into the basket and exceeding a given size.

In an advantageous embodiment, the dishwashing machine additionally comprises: a tubular element which protrudes upwards from the dome-shaped upper portion of the cup-shaped filtering body so as to form a longitudinal extension of the inner tubular segment, and which additionally extends in cantilever manner inside the catchment tank towards the main pass-through opening of the plate-like water conveyor; and a top container which is located on the upper end of said tubular element, and is suitably dimensioned to close the pass-through opening of said plate-like water conveyor and optionally also accommodate the strainer member; said top container having a water-permeable structure and being dimensioned to hold/block the foodstuff particulates and other solid contaminants in suspension in the liquid arriving into the same top container and exceeding a given size; the tubular element being structured to put the inside of the top container in direct fluid communication with the inner tubular segment.

Preferably, the top container is substantially basin-shaped and is dimensioned to substantially abut onto the plate-like water conveyor, all around the main pass-through opening of the plate-like water conveyor, so as to close the main pass-through opening and accommodate the strainer member.

Preferably, the tubular element is coupled in detachable manner to the dome-shaped upper portion of said cup-shaped filtering body.

Preferably, a lower end of said tubular element is axially fitted in manually extractable manner into a corresponding and substantially complementary-shaped, tubular seat or cavity formed in the dome-shaped upper portion of the cup-shaped filtering body, all around the upper section of the inner tubular segment.

Advantageously, the top container directly communicates with the adjoining tubular element via a second pass-through opening formed on a water-impermeable bottom wall of the same top container.

More preferably, a number of protruding ribs are arranged on said bottom wall around said second pass-through opening.

Advantageously, the outer casing is additionally provided with a pass-through tunnel extending substantially horizontally within the outer casing, and preferably with linear conveyor adapted to advance a succession of dishwasher racks along said pass-through tunnel; the inner washing cavity being located inside said pass-through tunnel.

A non-limiting embodiment of the present invention will now be described, by way of example, with reference to the accompanying drawings, in which.

Figure 1:
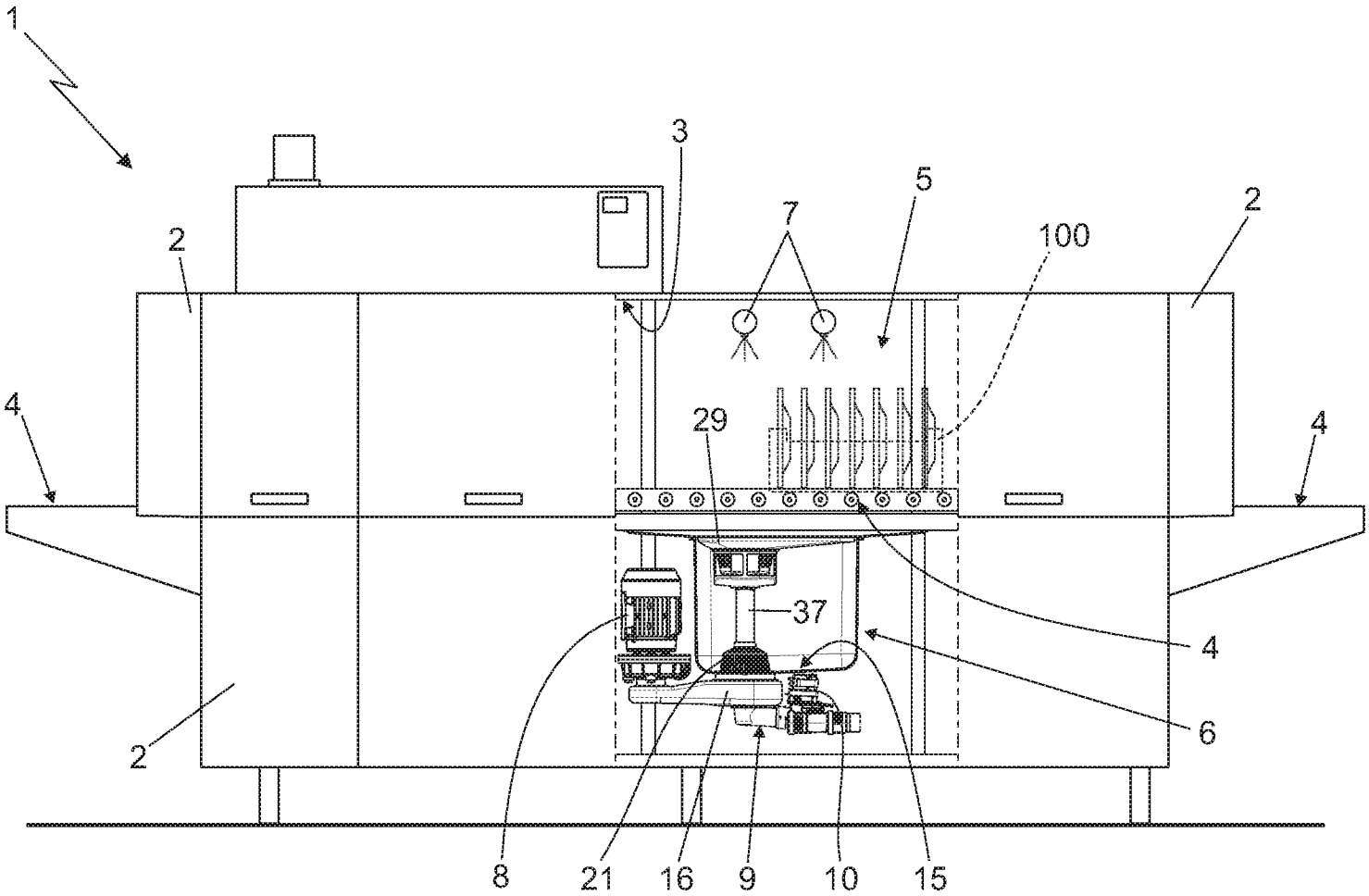
FIG. 1 is a schematic side view, with parts in section and parts removed for clarity, of a rack-type tunnel dishwashing machine realized according to the teachings of the present invention.
Figure 2:
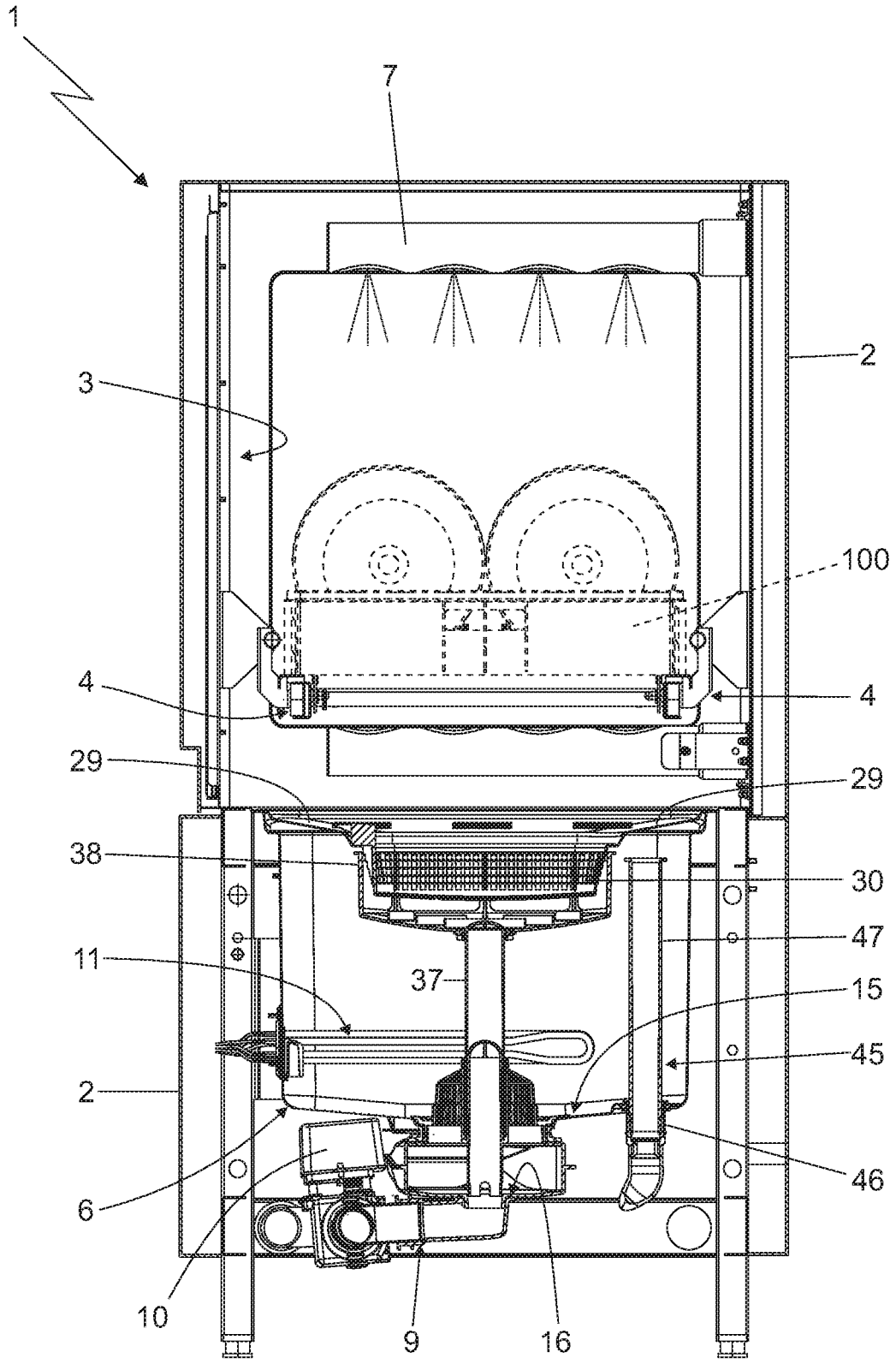
FIG. 2 is a sectioned front view of the dishwashing machine shown in FIG. 1, with parts removed for clarity.

With reference to FIGS. 1 and 2, reference number 1 indicates as a whole a dishwashing machine 1 preferably particularly adapted to rapidly wash up and rinse a succession of known dishwasher racks 100 each accommodating some dishware, cutlery or the like.

More specifically, the dishwashing machine 1 is preferably a tunnel dishwashing machine that preferably basically comprises: a preferably substantially parallelepiped-shaped, boxlike outer casing 2 which is provided with a preferably substantially rectilinear, pass-through tunnel 3 extending substantially horizontally inside the outer casing 2; and a preferably electrically-powered, linear conveyor 4 adapted to advance a succession of dishwasher racks 100 along the inner tunnel 3.

With reference to FIGS. 1 and 2, a preferably intermediate portion of the inner tunnel 3 is additionally divided into a washing section 5 and a rinsing section (not visible in the figures) arranged one downstream the other, so as to be crossed in succession by each dishwasher rack 100 travelling inside the tunnel 3.

Preferably the dishwashing machine 1 additionally includes: at least one and preferably a number of pre-wash sections (not visible in the figures) arranged along the inner tunnel 3 in sequence upstream of washing section 5; and a drying section (not visible in the figures) arranged along the inner tunnel 3 downstream of the rinsing section. Optionally, the dishwashing machine 1 may have, inside the inner tunnel 3, a sequence of washing sections 5 and a rinsing sections arranged one downstream the other.

At washing section 5, a number of high-pressure jets of a relatively-hot washing liquid are directed towards the dishwasher rack 100 momentarily traveling inside the washing section, so as to remove the filth from the dishware placed inside said dishwasher rack 100. Furthermore the washing liquid is preferably a mixture of hot water and one or more detergent agents, and the temperature of the washing liquid preferably ranges between 60° C. and 70° C.

At rinsing section of inner tunnel 3, a number of high-pressure jets of a hot rinsing liquid are directed towards the dishwasher rack 100 momentarily travelling inside the rinsing section, so as to remove any residual of washing liquid from the dishware placed inside said dishwasher rack 100 and preferably also sanitize the same dishware. Furthermore the rinsing liquid is preferably hot water or a mixture of hot water and one or more rinse agents, and the temperature of the washing liquid preferably ranges between 70° C. and 90° C.

At each pre-wash section of inner tunnel 3, a number of high-pressure jets of cold water are directed towards the dishwasher rack 100 momentarily traveling inside the pre-wash section, so as to remove the filth from the dishware placed inside said dishwasher rack 100.

With reference to FIGS. 1 and 2, to collect the cold water, the washing liquid or the rinsing liquid trickling down from the dishwasher racks 100 traveling inside the tunnel 3, the dishwashing machine 1 includes at least one and preferably a series of discrete catchment sink assemblies 6 (only the catchment sink assembly of washing section 5 is shown in FIGS. 1 and 2), which are arranged on the bottom of inner tunnel 3 one downstream the other, so as to separately collect and accumulate the cold water, the washing liquid or the rinsing liquid trickling down from the dishwasher rack 100 momentarily traveling inside, respectively, the/each pre-wash section, the washing section 5 or the rinsing section of inner tunnel 3.

More in detail, the dishwashing machine 1 preferably includes: at least a first catchment sink assembly 6 which is located on the bottom of the inner tunnel 3, inside the washing section of tunnel 3, so as to collect and accumulate the washing liquid trickling down from the dishwasher rack 100 momentarily traveling inside the washing section; and preferably also at least a second catchment sink assembly (not shown in the figures) which is located on the bottom of the inner tunnel 3, inside the rinsing section of inner tunnel 3 (i.e. downstream of catchment sink assembly 6), so as to collect and accumulate the rinsing liquid trickling down from the dishwasher rack 100 momentarily traveling inside the rinsing section.

Preferably the dishwashing machine 1 additionally includes, for each pre-wash section of inner tunnel 3, a further catchment sink assembly (not shown in the figures) which is located on the bottom of the inner tunnel 3, so as to collect and accumulate the cold water trickling down from the dishwasher rack 100 momentarily traveling inside the same pre-wash section.

With reference to FIGS. 1 and 2, preferably the dishwashing machine 1 additionally comprises, inside the washing section 5 of inner tunnel 3: a number of nozzles 7 which are arranged inside the tunnel 3, above the catchment sink assembly 6, and are oriented so as to direct the corresponding jets of washing liquid towards the dishwasher rack 100 momentarily traveling inside the washing section of inner tunnel 3; and at least one, preferably electrically-powered, circulating pump 8 which sucks the washing liquid from the catchment sink assembly 6, and feeds said washing liquid to the nozzles 7 with a given pressure preferably ranging between 1.5 and 3 bars.

The dishwashing machine 1 additionally comprises, for the washing section 5, a water drain line 9 that preferably communicates with an external sewage system, and preferably includes a preferably electrically-operated, on-off valve 10 capable of controlling the outflow of the washing or rinsing liquid from the catchment sink assembly 6, thus to selectively empty the catchment sink assembly 6.

Preferably, the dishwashing machine 1 additionally comprises, for washing section 5: a preferably electrically-powered, heating device 11 which is preferably located inside the catchment sink assembly 6, and is capable of heating up the washing liquid contained into the catchment sink assembly 6; and/or a temperature sensor (not shown in the figures) which is preferably located inside the catchment sink assembly 6, and is capable of determining the current temperature of the washing liquid contained into the catchment sink assembly 6; and/or a level sensor (not shown in the figures) which is preferably located inside the catchment sink assembly 6, and is capable of determining the current level of the washing liquid contained into the catchment sink assembly 6.

Preferably the dishwashing machine 1 has a similar component layout for the rinsing section and optionally also for the/each pre-wash section of inner tunnel 3.

In other words, the dishwashing machine 1 preferably comprises, inside the rinsing section (not shown in the figures) of inner tunnel 3: a number of nozzles which are arranged inside the tunnel 3, above the corresponding catchment sink assembly, and are oriented so as to direct the corresponding jets of rinsing liquid towards the dishwasher rack 100 momentarily traveling inside the rinsing section; and at least one, preferably electrically-powered, circulating pump which sucks the rinsing liquid from the same catchment sink assembly, and feeds said rinsing liquid to said nozzles with a given pressure preferably ranging between 1.5 and 3 bars.

Preferably, a heating device and/or a temperature sensor and/or a level sensor is/are additionally located inside the catchment sink assembly of the rinsing section.

With reference to FIGS. from 2 to 9, the/each catchment sink assembly 6 basically comprises: a large basin-shaped catchment tank 15 which is preferably substantially rectangular in shape, is preferably dimensioned to contain an amount of water equal to or greater than 50 litres, and is arranged on the bottom of inner tunnel 3 with the concavity turned upwards, so as to collect and accumulate the liquid trickling down from the dishwasher rack 100 momentarily traveling above the catchment tank 15; and a drain sump 16, preferably substantially cup-shaped, that extends downwards from the bottom of catchment tank 15 and directly communicates with the inside of catchment tank 15 so as to receive by gravity the washing or rinsing liquid arriving on the bottom of catchment tank 15.

Circulating pump 8 directly communicates with drain sump 16 so as to suck the washing liquid or rinsing liquid from the inside of drain sump 16. Water drain line 9, in turn, directly communicates with drain sump 16 to selectively drain the washing liquid or rinsing liquid from the inside of drain sump 16.

Figure 3:
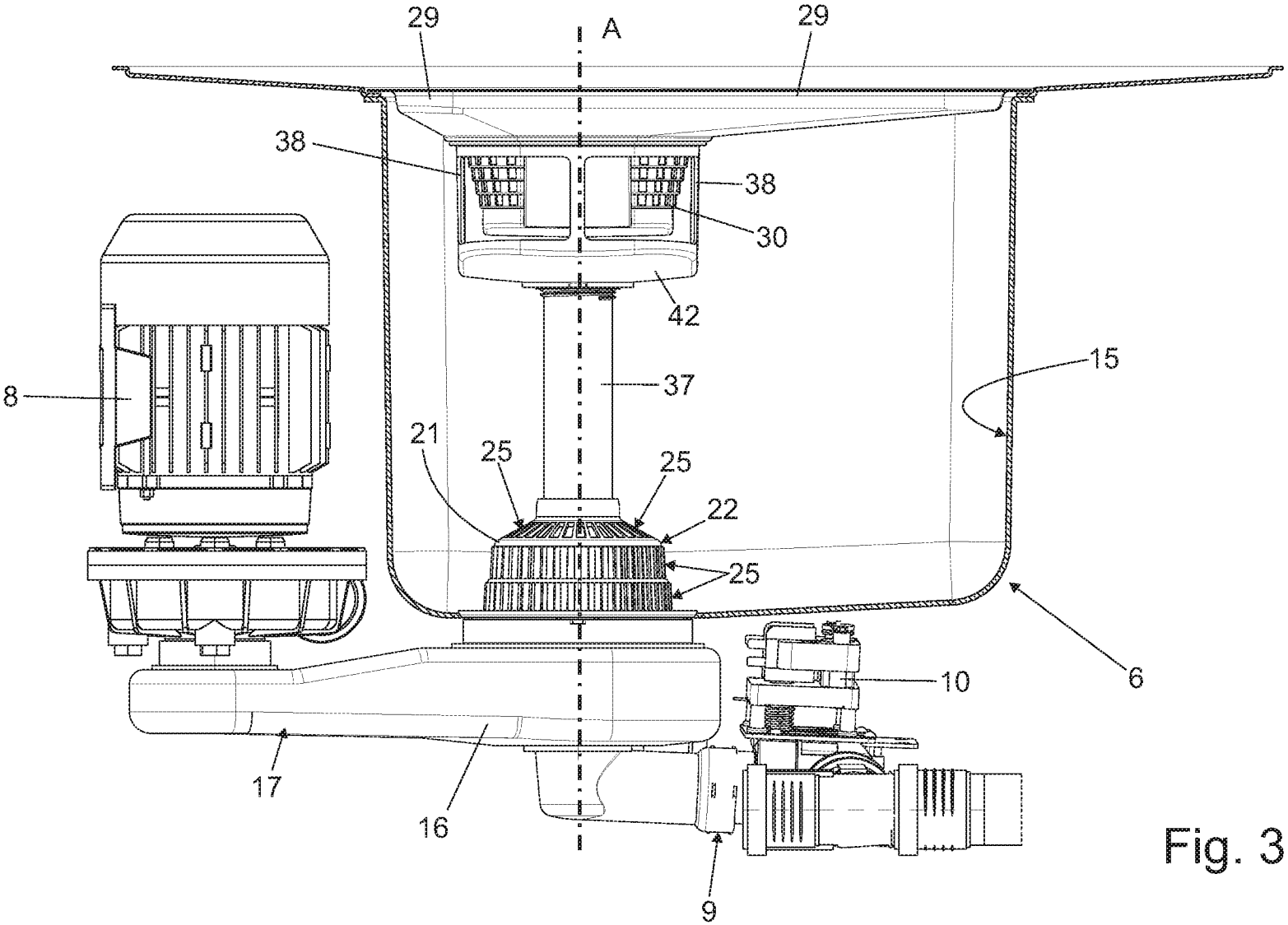
FIG. 3 is an enlarged side view of the catchment sink assembly shown in FIGS. 1 and 2, with parts in section and parts removed for clarity.

More specifically, with particular reference to FIG. 3, circulating pump 8 is preferably arranged beside the catchment tank 15, and the suction mouth of circulating pump 8 is preferably fitted/coupled in watertight manner to the distal end of an oblong branching portion 17 of drain sump 16 that extends transversally beneath the bottom of catchment tank 15, preferably while remaining locally substantially perpendicular to a substantially vertically-oriented, main axis A.

Figure 4:
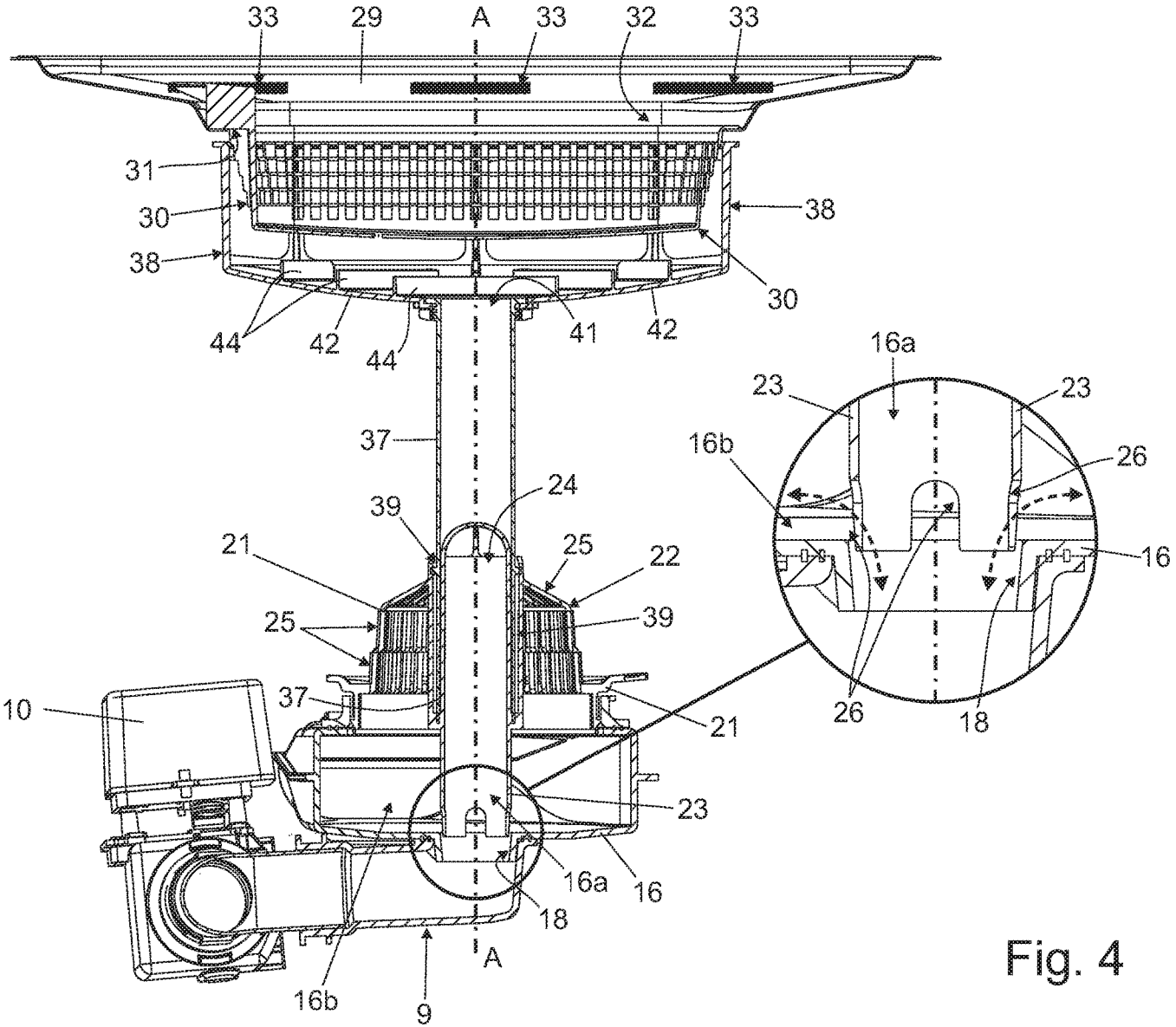
FIG. 4 is an enlarged front view of the catchment sink assembly shown in FIGS. 2, 3 and 4, with parts in section and parts removed for clarity.
Figure 5:
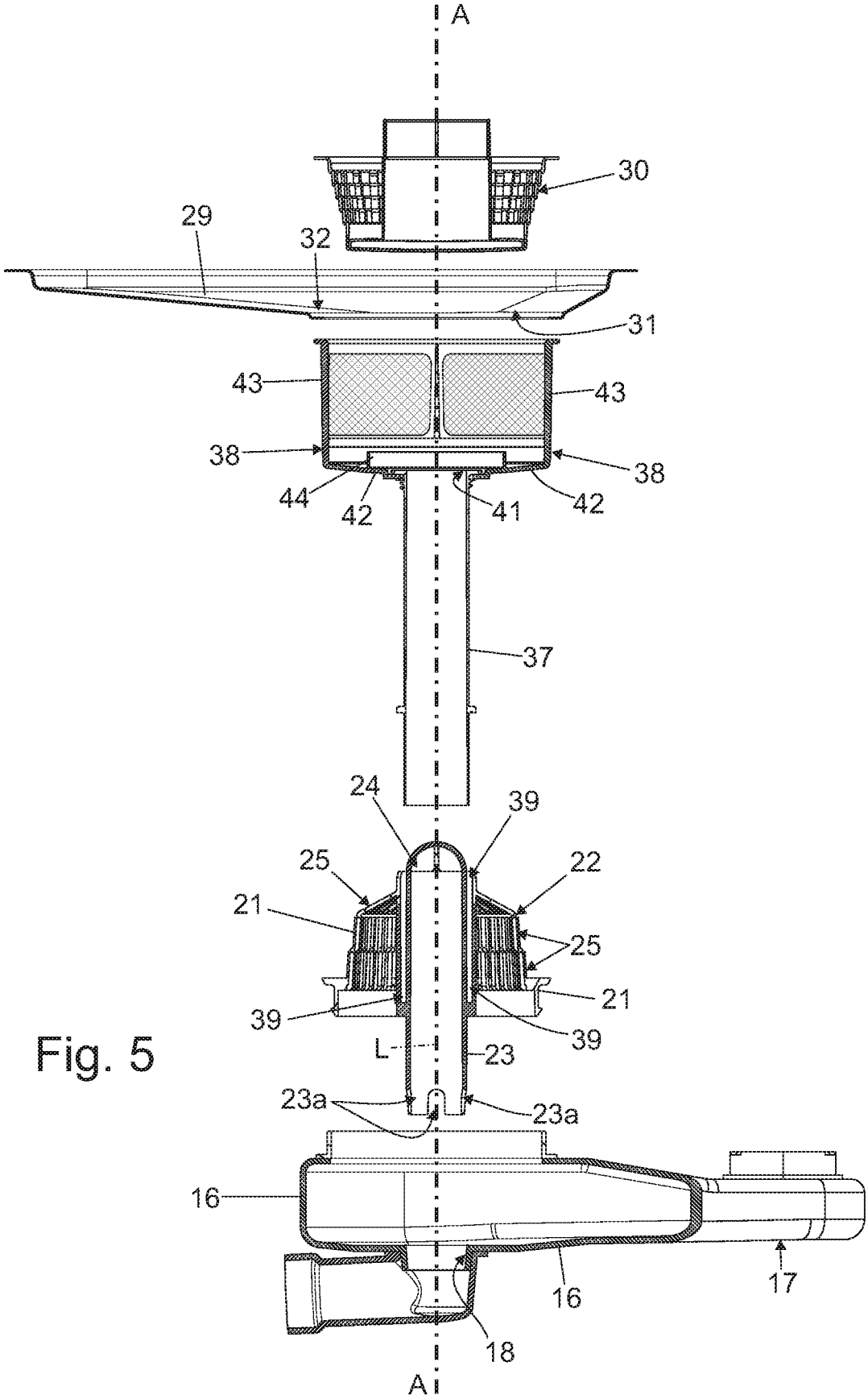
FIG. 5 is an exploded, front view of the catchment sink assembly shown in FIG. 4, with parts in section and parts removed for clarity.
Figure 7:
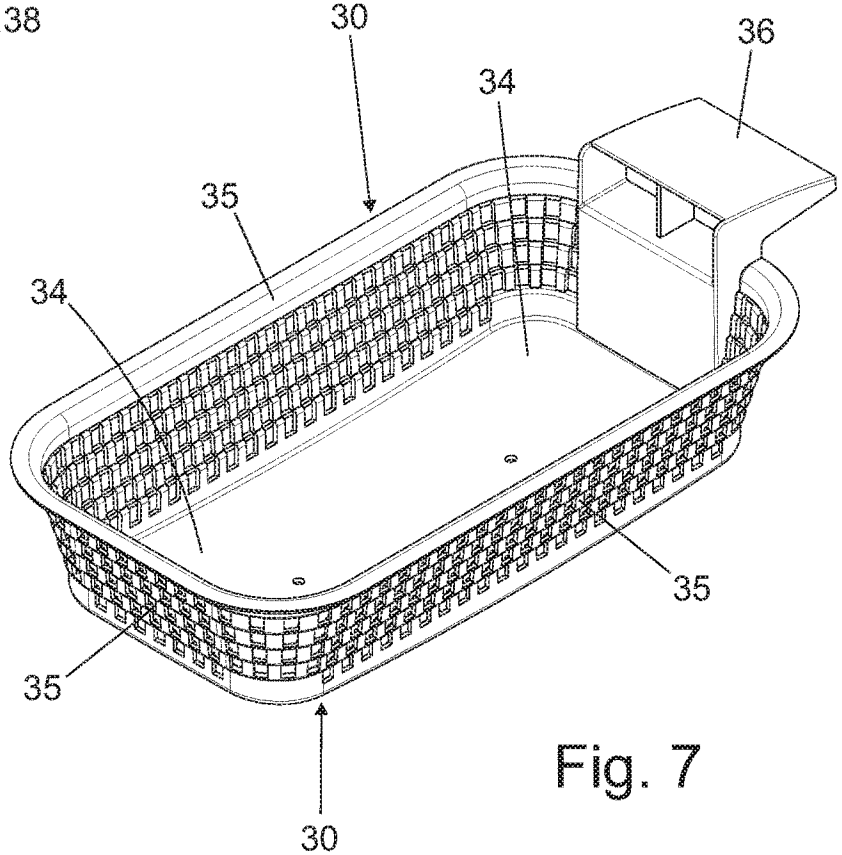
FIGS. 6, 7, 8 and 9 are perspective views of as many components of the catchment sink assembly shown in FIGS. 2, 3, 4 and 5.

With reference to FIGS. 4 and 5, drain sump 16 moreover has, on the bottom wall, a tubular outlet portion 18 that extends downwards, preferably while remaining locally substantially parallel to main axis A, and the water drain line 9 of dishwashing machine 1 directly communicates with said tubular outlet portion 18.

More specifically, the tubular outlet portion 18 of drain sump 16 is preferably substantially cylindrical in shape, and preferably extends downwards while remaining locally substantially coaxial to main axis A.

With reference to FIGS. 2 to 5 and 9, the/each catchment sink assembly 6 additionally comprises a cup-shaped filtering body 21 which is fitted in manually detachable manner into the upper rim of drain sump 16 with the concavity turned downwards and towards the inside of drain sump 16, so as to close the drain sump 16 preferably substantially in watertight manner. This cup-shaped filtering body 21 additionally has: a substantially dome-shaped, water-permeable upper portion 22 that preferably protrudes upwards inside catchment tank 15; and a preferably substantially straight, inner tubular segment 23 that protrudes downwards from the dome-shaped upper portion 22, and extends in cantilever manner into the drain sump 16 preferably while remaining substantially parallel to the longitudinal axis L of cup-shaped body 21, i.e. locally substantially parallel to main axis A, up to substantially fit in detachable manner into the tubular outlet portion 18 of drain sump 16.

The inner tubular segment 23 of cup-shaped filtering body 21 therefore divides the inner volume of drain sump 16 into a first inner-volume portion 16*a* directly communicating with the water drain line 9, and into a second inner-volume portion 16*b* directly communicating with the suction of circulating pump 8.

The dome-shaped upper portion 22 of cup-shaped filtering body 21 additionally preferably has: a relatively large, pass-through opening 24 which is aligned to the inner tubular segment 23, so as to put the inner tubular segment 23, i.e. the first inner-volume portion 16*a* of drain sump 16, in direct fluid communication with the outside; and a water filtering area 25 which is misaligned to the inner tubular segment 23, so as to put the second inner-volume portion 16*b* of drain sump 16 in direct fluid communication with the outside.

The pass-through opening 24 is suitably dimensioned to allow relatively big foodstuff particulates and similar solid contaminants in suspension in the washing or rinsing liquid contained into catchment tank 15, to freely enter into the inner tubular segment 23, i.e. into the inner-volume portion 16*a* of drain sump 16. The water filtering area 25, in turn, is suitably structured to allow the washing or rinsing liquid contained into catchment tank 15 to freely enter into the second inner-volume portion 16*b* of drain sump 16 while, at same time, preventing the foodstuff particulates and/or other solid contaminants in suspension in the washing or rinsing liquid and exceeding a given size to enter into the same drain sump 16, i.e. to enter into the second inner-volume portion 16*b* of drain sump 16.

The cup-shaped filtering body 21, therefore, is arranged upstream of the suction of circulating pump 8, and is capable of holding/blocking at least part of the foodstuff particulates or other solid contaminants in suspension in the washing or rinsing liquid entering into drain sump 16, directed towards the circulating pump 8.

With reference to FIGS. 2 and 4, additionally one or more auxiliary water passages 26 are formed, substantially at or in proximity of the tubular outlet portion 18 of drain sump 16, so as to put the first inner-volume portion 16*a* of drain sump 16 in permanent fluid communication with the adjacent second inner-volume portion 16*b*.

Moreover these one or more auxiliary water passages 26 are preferably dimensioned to prevent any foodstuff particulates or other solid contaminants in suspension in the washing or rinsing liquid and exceeding a given size, to freely move from the first inner-volume portion 16*a* to the second inner-volume portion 16*b* or vice versa.

Preferably these one or more auxiliary water passages 26 are furthermore at least partly formed on the inner tubular segment 23 of cup-shaped filtering body 21.

More specifically, the one or more auxiliary water passages 26 are preferably located on the distal end of the inner tubular segment 23.

In other words, the distal end of the inner tubular segment 23 is preferably provided with one or more cut-out portions 26, which are preferably substantially horizontally aligned to the upper rim of the tubular outlet portion 18 of drain sump 16, and are preferably suitably dimensioned to allow the washing or rinsing liquid to freely flow in and out of the inner tubular segment 23, through the lateral wall of the same inner tubular segment 23. These one or more cut-out portions 26, therefore, put the first inner-volume portion 16*a* and the second inner-volume portion 16*b* of drain sump 16 in permanent fluid communication to one another.

Preferably, these one or more cut-out portions 26 are furthermore suitably dimensioned to prevent almost any foodstuff particulates or other solid contaminants in suspension in the washing or rinsing liquid present into the inner tubular segment 23 and exceeding a given size, to freely move into the second inner-volume portion 16*b* of drain sump 16.

In the example shown, in particular, the dome-shaped upper portion 22 of cup-shaped filtering body 21 is preferably substantially ogival in shape, and preferably protrudes inside catchment tank 15. The pass-through opening 24 moreover is preferably substantially circular in shape, and is preferably located roughly at tip of the dome-shaped upper portion 22, i.e. nearly at centre of the dome-shaped upper portion 22.

Figure 9:
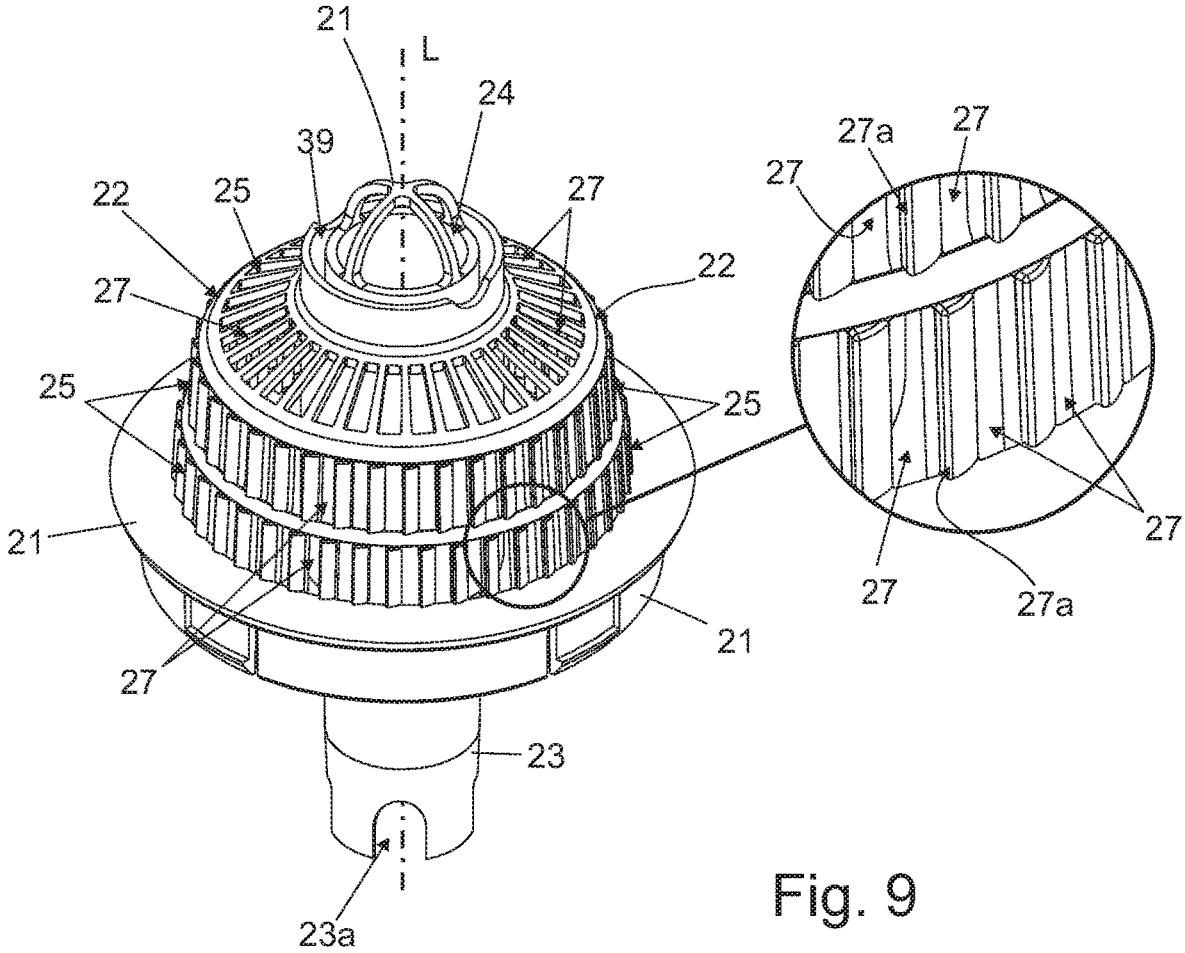

With particular reference to FIG. 9, the water filtering area 25 of the dome-shaped upper portion 22, instead, is preferably annular in shape, so as to surround the pass-through opening 24. Preferably the water filtering area 25 moreover comprises at least one and preferably a number of concentric annular sectors of the dome-shaped upper portion 22, wherein each annular sector is provided with a series of oblong pass-through slits 27 that are preferably angularly staggered around the pass-through opening 24, and are suitably dimensioned to prevent the foodstuff particulates and other solid contaminants in suspension in the washing or rinsing liquid contained into catchment tank 15 and exceeding a given size, to freely enter into the second inner-volume portion 16*b* of drain sump 16.

Furthermore, the oblong pass-through slits 27 of one or more of said annular sectors are preferably laterally delimited by straight longitudinal edges 27*a* having a substantially sharp profile, so as to be able to cut almost any stringy material in suspension in the washing or rinsing liquid contained into catchment tank 15 and passing though the water filtering area 25 of the dome-shaped upper portion 22.

With particular reference to FIGS. 4, 5 and 9, the inner tubular segment 23, in turn, is preferably substantially cylindrical in shape, and extends in cantilever manner into the drain sump 16 preferably while remaining substantially coaxial to the longitudinal axis L of cup-shaped body 21, i.e. locally substantially coaxial to main axis A, up to fit into the tubular outlet portion 18 of drain sump 16.

Preferably the lower annular rim of inner tubular segment 23 is moreover provided with at least one and preferably a series of slotted indentations 23*a*, which are preferably angularly staggered around the longitudinal axis of the inner tubular segment 23, and are adapted to form, together with the upper rim of tubular outlet portion 18, a corresponding number of pass-through openings 26 each of which allows free flow/passage of the washing or rinsing liquid from the first inner-volume portion 16*a* of drain sump 16 to the second inner-volume portion 16*b* or vice versa. Preferably each of these pass-through openings 26 is furthermore dimensioned to prevent almost any foodstuff particulates or other solid contaminants in suspension in the washing or rinsing liquid and exceeding a given size, to move from the first inner-volume portion 16*a* of drain sump 16 to the second inner-volume portion 16*b* or vice versa.

With reference to FIGS. 2, 3, 4, 5, 7 and 8, the/each catchment sink assembly 6 preferably additionally comprises an upper plate-like water conveyor 29 and optionally also a strainer member 30.

The plate-like water conveyor 29 is preferably substantially complementary in shape to the upper mouth of catchment tank 15, and is arranged to close the upper mouth of catchment tank 15 and collect the washing or rinsing liquid trickling down from the dishwasher rack 100 momentarily traveling above the catchment tank 15. In other words, the plate-like water conveyor 29 is preferably arranged substantially horizontally in abutment on the upper rim of catchment tank 15

The plate-like water conveyor 29 is furthermore provided with a preferably relatively large, main pass-through opening 31 through which the washing or rinsing liquid trickling down from the dishwasher rack 100 momentarily traveling above the catchment tank 15 falls by gravity into catchment tank 15. Preferably this pass-through opening 31 is moreover substantially vertically aligned to the beneath-located drain sump 16 and cup-shaped filtering body 21.

The strainer member 30, in turn, is preferably fitted in removable manner into the pass-through opening 31 of the plate-like water conveyor 29, preferably so as to completely or almost completely close the pass-through opening 31, and it is structured to hold/block the foodstuff particulates and other solid contaminants in suspension in the washing or rinsing liquid passing/flowing through the same strainer member 30 and exceeding a given size.

Figure 8:
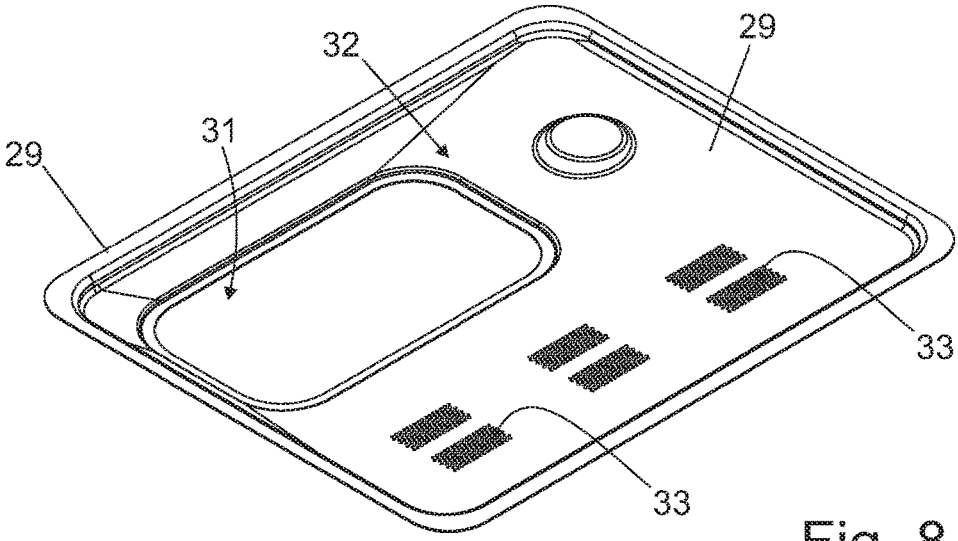

More in detail, with particular reference to FIG. 8, the upper plate-like water conveyor 29 preferably has a downwards-converging hopper portion 32, which is preferably formed approximately in the middle of water conveyor 29, and ends into a preferably substantially rectangular-shaped, pass-through opening 31. Optionally the upper plate-like water conveyor 29 additionally has one or more perforated areas 33 each suitably dimensioned to hold/block the foodstuff particulates and other solid contaminants arriving onto the plate-like water conveyor 29 and exceeding a given size.

The strainer member 30, in turn, is preferably substantially complementary in shape to the lower section of the hopper portion 32 of plate-like water conveyor 29, so as to fit into the lower section of hopper portion 32 to close the pass-through opening 31. Preferably the strainer member 30 is furthermore structured/shaped so as to partly protrude underneath the plate-like water conveyor 29 via pass-through opening 31, towards the drain sump 16 and the cup-shaped filtering body 21.

More in detail, with particular reference to FIGS. 3, 4, 5 and 7 the strainer member 30 preferably basically includes a basin-shaped basket having a water-permeable structure and which is preferably substantially complementary in shape to the lower section of the hopper portion 32 of plate-like water conveyor 29, so as to fit into the lower section of hopper portion 32, i.e. it is preferably substantially rectangular in shape, and is preferably also dimensioned to partly protrude underneath the plate-like water conveyor 29 via pass-through opening 31, towards the drain sump 16 and the cup-shaped filtering body 21.

Preferably this basin-shaped basket moreover has a preferably substantially flat, water-impermeable bottom wall 34, and at least one and preferably all its side walls 35 permeable to water and suitable structured to hold/block the foodstuff particulates and other solid contaminants in suspension in the washing or rinsing liquid arriving into the basket and exceeding a given size.

In the example shown, in particular, each sidewall 35 of the basin-shaped water-permeable basket preferably has a meshed structure suitably dimensioned to hold/block the foodstuff particulates and other solid contaminants in suspension in the washing or rinsing liquid arriving into the basket and exceeding a given size.

Preferably, the basin-shaped water-permeable basket is finally provided with a manually-sizable handle 36 to ease the manual extraction/removal of the water-permeable basket 30 from the plate-like water conveyor 29.

With reference to FIGS. 2 to 6, the/each catchment sink assembly 6 preferably additionally comprises: a preferably straight, tubular element 37 which protrudes upwards from the dome-shaped upper portion 22 of cup-shaped filtering body 21 so as to form a longitudinal extension of the inner tubular segment 23, and moreover extends in cantilever manner inside the catchment tank 15, towards the pass-through opening 31 of plate-like water conveyor 29, preferably while reaming substantially parallel or even coaxial to main axis A; and a top container 38 which has a water-permeable structure, is firmly and stably fitted onto the upper end of tubular element 37, and is dimensioned so as to substantially close the pass-through opening 31 of water conveyor 29 and optionally also accommodate the strainer member 30.

More in detail, the top container 38 is preferably substantially basin-shaped, and is preferably suitably dimensioned so as to nearly abut with its upper annular rim against the lower face of the plate-like water conveyor 29, all around the pass-through opening 31 of plate-like water conveyor 29, so as to close the pass-through opening 31 and optionally also accommodate the strainer member 30.

The water-permeable top container 38 is suitably structured to hold/block the foodstuff particulates and other solid contaminants in suspension in the washing or rinsing liquid arriving into the same top container 38 and exceeding a given size; whereas the tubular element 37 is structured to put the inside of top container 38 in direct fluid communication with the inner tubular segment 23, so that the washing or rinsing liquid arriving/contained into the water-permeable top container 38 is allowed to freely flow inside the tubular element 37, straight towards the inner tubular segment 23 and the tubular outlet portion 18 of drain sump 16.

Preferably, the tubular element 37 is furthermore coupled to the dome-shaped upper portion 22 of cup-shaped filtering body 21 in manually detachable manner.

More specifically, the lower end of tubular element 37 is preferably axially fitted in manually extractable manner into a corresponding and substantially complementary-shaped, tubular seat or cavity 39 formed in the dome-shaped upper portion 22 of cup-shaped filtering body 21, all around the upper section of the inner tubular segment 23. Tubular element 37 therefore is fitted/fittable in telescopic manner onto the upper section of the inner tubular segment 23, so as to solely communicate with the inner tubular segment 23 via the large pass-through opening 24 on the dome-shaped upper portion 22 of cup-shaped filtering body 21.

With reference to FIGS. 3, 4, 5 and 6, the water-permeable top container 38, in turn, is preferably substantially rectangular in shaped so as to accommodate the portion of strainer member 30, or better the portion of the water-permeable basket, protruding underneath the plate-like water conveyor 29. Moreover, the water-permeable top container 38 preferably directly communicates with the adjoining tubular element 37 via a relatively large, pass-through opening 41 preferably formed on a preferably water-impermeable, bottom wall 42 of the same top container 38. Preferably the bottom wall 42 of top container 38 is moreover substantially flat or slightly converging to the pass-through opening 41, whereas the pass-through opening 41 is preferably located nearly in the middle of the same bottom wall 42.

Preferably, the water-permeable top container 38 furthermore has at least one and preferably all its side walls 43 permeable to water and suitably structured to hold/block the foodstuff particulates and other solid contaminants in suspension in the washing or rinsing liquid arriving into the same water-permeable top container 38 and exceeding a given size.

Figure 6:
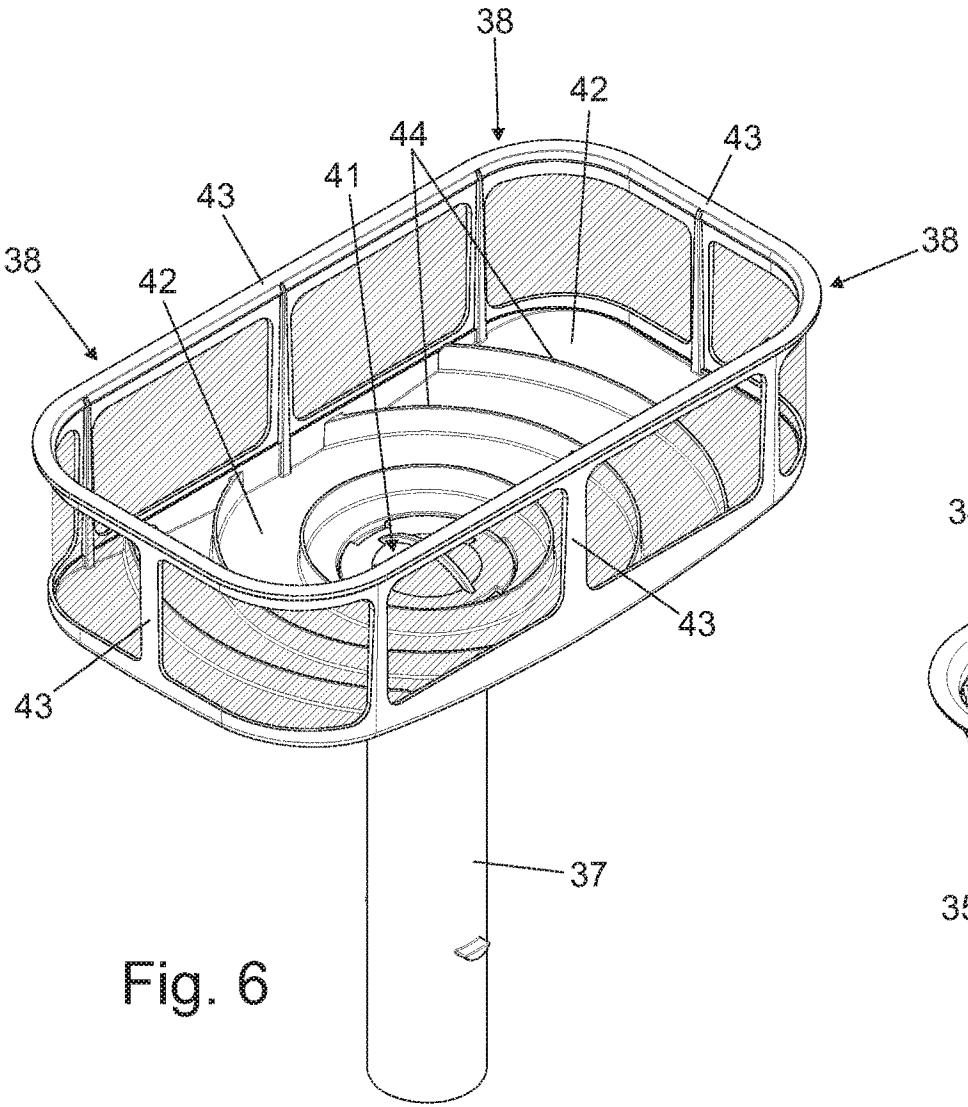

With reference to FIG. 6, advantageously in the example shown each sidewall 43 of the water-permeable top container 38 preferably has one or more large pass-through openings each closed by a meshed sheet suitably dimensioned to hold/block the foodstuff particulates and other solid contaminants in suspension in the washing or rinsing liquid arriving into the water-permeable top container 38 and exceeding a given size.

Preferably the water-permeable top container 38 is finally provided with at least one and preferably a number of protruding ribs 44 that protrude upwards from bottom wall 42 of the water-permeable top container 38 all around the pass-through opening 41, so as to improve sedimentation and accumulation, on the bottom wall 42, of the relatively-bigger foodstuff particulates and other solid contaminants in suspension in the washing or rinsing liquid arriving into the same water-permeable top container 38.

With reference to FIG. 2, preferably the catchment sink assembly 6 finally comprises an overflow piping 45 which is preferably at least partly located into catchment tank 15, and is structured to automatically drain, out of catchment tank 15, the washing or rinsing liquid exceeding a given maximum level. Preferably this overflow piping 45 is moreover structured to channel said exceeding washing or rinsing liquid towards the water drain line 9, preferably downstream of the on-off valve 10.

Preferably the overflow piping 45 furthermore includes: a shoe fitting 46 which is placed on the bottom of catchment tank 15 spaced beside the drain sump 16, and directly communicates with the water drain line 9 via a connecting pipe preferably joining the water drain line 9 downstream of the on-off valve 10; and an upright pipe 47 which is fitted, preferably in substantially watertight manner, into the shoe fitting 46, and moreover extends upwards inside the catchment tank 15 up to a give distance from the upper annular rim of the catchment tank 15, i.e. up to a given distance from the superjacent plate-like water conveyor 29.

Preferably the upright pipe 47 is furthermore dimensioned so that the upper mouth of the same upright pipe 47 is located substantially horizontally aligned beside the annular upper rim of the top container 38.

General operation of the dishwashing machine 1 is easily inferable from the description above.

As regards the catchment sink assembly 6, the washing or rinsing liquid trickling down from the dishwasher rack 100 momentarily travelling above the catchment sink assembly 6 arrives at circulating pump 8 after passing through a succession of three filtering members: the strainer member 30, the water-permeable top container 38, and finally the water filtering area 25 of the dome-shaped upper portion 22 of cup-shaped filtering body 21.

Tubular element 37 and the inner tubular segment 23 of cup-shaped filtering body 21, in turn, directly channels the washing or rinsing liquid having in suspension relatively-big foodstuff particulates and other solid contaminants straight towards the tubular outlet portion 18 of drain sump 16, without polluting the washing or rinsing liquid directed towards the suction of circulating pump 8.

On the other hand, when the on-off valve 10 of water drain line 9 is set in the opened position, the auxiliary water passages 26 at level of the tubular outlet portion 18 of drain sump 16 allow to completely empty, at same time, the catchment tank 15, the drain sump 16 and finally the circulating pump 8, even if the cup-shaped filtering body 21 is still correctly fitted into the upper mouth of drain sump 16.

Moreover, to remove/drain from the drain sump 16 any foodstuff particulates or other solid contaminants accumulated into the second inner-volume portion **16*b* of drain sump 16 and too big to pass through the auxiliary water passages 26, it suffices to manually remove the inner tubular segment 23 of the cup-shaped filtering body 21 from the tubular outlet portion 18 of drain sump 16**.

The advantages resulting from the particular structure of catchment sink assembly 6 are remarkable.

The tubular member creates a direct communication between the internal of the catchment tank and the water drain line, and in this way it facilitates the draining of foodstuff particulates or other solid contaminants in suspension in the liquid present into the catchment tank. On the same time the tubular member delimits a second inner-volume portion by which the internal of the catchment tank is connected to the pump that sucks the liquid from the catchment sink assembly and feeds this liquid to the nozzles; in this way it is ensured that at least a part of the liquid present into the catchment tank is circulated by the pump.

In the advantageous embodiment in which the auxiliary water passages 26 are provided at level of the tubular outlet portion of drain sump 16, they allow to completely empty the catchment sink assembly 6 without removing the cup-shaped filtering body 21, thus greatly simplifying the maintenance and/or cleaning operations of catchment sink assembly 6.

Furthermore the cup-shaped filtering body 21, the tubular element 37 with the water-permeable top container 38, the plate-like water conveyor 29 and the strainer member 30 form altogether an easy manually-dismountable, modular filtering device that offers several alternative filtering layouts.

The modular filtering device, in fact, can operate properly, for example, without the tubular element 37 having the water-permeable top container 38 on top; without the strainer member 30 into the plate-like water conveyor 29; or even solely with the cup-shaped filtering body 21.

Clearly, changes may be made to dishwashing machine 1 and to catchment sink assembly 6 without, however, departing from the scope of the present invention.

Figure 10:
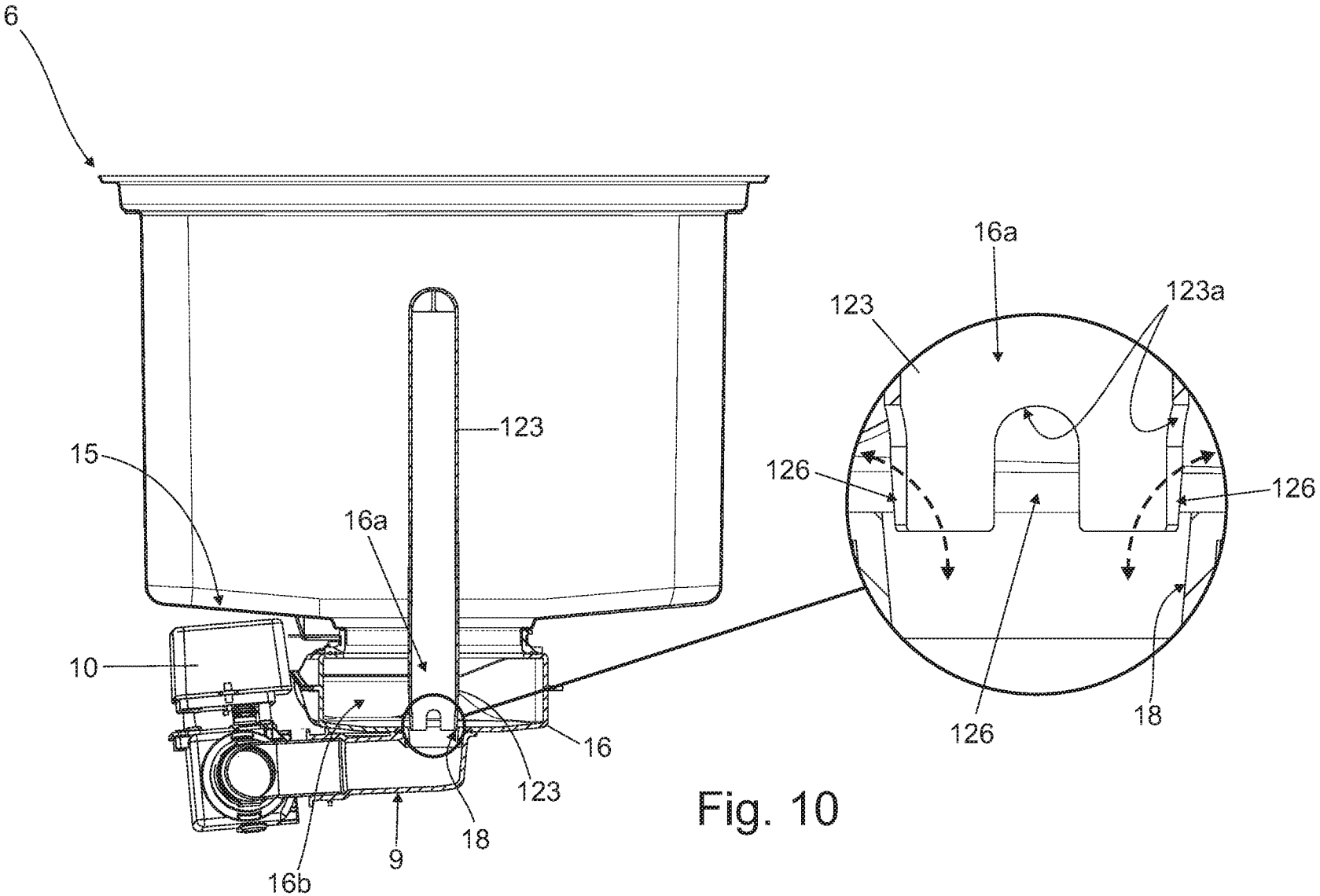
FIG. 10 is an enlarged side view of an alternative embodiment of the catchment sink assembly shown in FIGS. 1 to 5, with parts in section and parts removed for clarity.

For example, with reference to FIG. 10, in a less-sophisticated embodiment the catchment sink assembly 6 lacks the plate-like water conveyor 29, the strainer member 30, and the tubular element 37 having the water-permeable container 38 on top. Furthermore, the catchment sink assembly 6 comprises, in place of the cup-shaped filtering body 21, a preferably substantially cylindrical, straight upright pipe 123 which is fitted in detachable manner into the tubular outlet portion 18 of drain sump 16 and additionally extends upwards inside the catchment tank 15 up to a give distance from the upper annular rim of the catchment tank 15.

Similarly to the inner tubular segment 23 of cup-shaped filtering body 21, therefore, the straight upright pipe 123 is in fluid communication with the inside of catchment tank 15 and moreover divides the inner volume of drain sump 16 into a first inner-volume portion 16*a* directly communicating with the water drain line 9, and into a second inner-volume portion 16*b* directly communicating with the suction of circulating pump 8.

Also in this less-sophisticated embodiment, one or more auxiliary water passages 126 are preferably formed, substantially at the tubular outlet portion 18 of drain sump 16, so as to put the first inner-volume portion 16*a* of drain sump 16 in permanent fluid communication with the adjacent second inner-volume portion 16*b*. Preferably these one or more auxiliary water passages 126 are moreover dimensioned to prevent any foodstuff particulates or other solid contaminants in suspension in the washing or rinsing liquid and exceeding a given size, to freely move from the first inner-volume portion 16*a* of drain sump 16 to the second inner-volume portion 16*b* of drain sump 16 or vice versa.

These one or more cut-out portions 126, therefore, put the first inner-volume portion 16*a* and the second inner-volume portion 16*b* of drain sump 16 in permanent fluid communication to one another Preferably, these one or more auxiliary water passages 126 are moreover at least partly formed on the straight upright pipe 123.

More specifically, these one or more auxiliary water passages 126 are preferably located on the lower end of the straight upright pipe 123.

In other words, the lower end of the straight upright pipe 123 is preferably provided with one or more cut-out portions 126, which are substantially horizontally aligned to the upper rim of the tubular outlet portion 18 of drain sump 16, and are suitably dimensioned to allow the washing or rinsing liquid to freely flow in and out of the straight upright pipe 123, through the lateral wall of the same straight upright pipe 123.

More specifically, with reference to FIG. 10, the lower annular rim of straight upright pipe 123 is preferably provided with at least one and preferably a series of slotted indentations 123*a*, which are preferably angularly staggered around the longitudinal axis of the straight upright pipe 123, and are adapted to form, together with the upper rim of tubular outlet portion 18, a corresponding number of pass-through openings 126 each of which allows free flow/passage of the washing or rinsing liquid from the first inner-volume portion 16*a* of drain sump 16 to the second inner-volume portion 16*b* or vice versa.

According to a non-shown alternative embodiment, furthermore, the dishwashing machine 1 may be a hood-type dishwashing machine.

In other words, the outer casing of the dishwashing machine 1 may be divided into a preferably substantially parallelepiped-shaped, lower portion which is adapted to rest on the ground and moreover incorporates, on top, the catchment sink assembly 6 and preferably also a supporting structure which is located immediately above the catchment sink assembly 6 and is adapted to support a dishwasher rack 100; and into a hood-shaped upper portion which is located above the lower portion, vertically aligned to the catchment sink assembly 6, and is vertically movable with respect to the lower portion between a lowered position and a raised position.

In the lower position, the hood-shaped upper portion of the machine outer casing rests in abutment on the top of the lower portion so as to delimit, immediately above the catchment sink assembly 6, a closed washing chamber which is dimensioned to accommodate a dishwasher rack 100 preferably stationary resting one the supporting structure. In the raised position, instead, the hood-shaped upper portion of the machine outer casing is spaced above the top of the lower portion so as to allow the easy manual positioning and removal of the dishwasher rack 100 from the horizontal supporting framework.

In this not-shown alternative embodiment, moreover, the nozzles 7 are preferably located on a substantially horizontally extending, rotatable arm which is usually pivotally joined onto the ceiling of the hood-shaped upper portion of the machine outer casing, so as to be able to freely rotate about a substantially vertical axis inside the washing chamber, immediately above the dishwasher rack 100.

Likewise the previous embodiment, the nozzles 7 on the rotatable arm are oriented so as to direct the corresponding jets of washing liquid or rinsing liquid towards the dishwasher rack 100 momentarily located inside the washing chamber.

Obviously, similarly to the previous embodiment, the nozzles 7 located on the rotatable arm receive the washing or rinsing liquid from the circulating pump 8 that sucks the washing or rinsing liquid from the catchment sink assembly 6.

The invention claimed is:

1. Dishwashing machine comprising: an outer casing which is provided with an inner washing cavity adapted to accommodate at least one dishwasher rack; a number of nozzles adapted to direct corresponding jets of liquid towards a dishwasher rack momentarily located inside said inner washing cavity; at least one catchment sink assembly which is located on the bottom of said inner washing cavity so as to collect and accumulate the liquid trickling down from a dishwasher rack momentarily located above said catchment sink assembly; and at least one pump that sucks the liquid from said catchment sink assembly and feeds said liquid to the nozzles with a given pressure;

said catchment sink assembly comprising: a basin-shaped catchment tank; a drain sump which extends downwards from the bottom of said catchment tank and directly communicates with the inside of the catchment tank so as to receive by gravity the liquid arriving on the bottom of the catchment tank; a plate-like water conveyor which is arranged to close the catchment tank so as to collect the liquid directed to the catchment tank and which is provided with a main pass-through opening through which said liquid falls into the catchment tank below, wherein a tubular member communicates with the catchment tank and is fitted in detachable manner into a corresponding tubular outlet portion formed in the drain sump, so as to divide the inner volume of the drain sump into a first inner-volume portion directly connected to a water drain line of the dishwashing machine, and a second inner-volume portion directly connected to the suction of said pump.

2. Dishwashing machine according to claim 1, wherein the catchment sink assembly includes one or more auxiliary water passages which are formed, at the tubular outlet portion of the drain sump, so as to put said first and second inner-volume portions of the drain sump in fluid communication to one another.

3. Dishwashing machine according to claim 2, wherein said one or more auxiliary water passages of the catchment sink assembly are at least partly formed in said tubular member.

4. Dishwashing machine according to claim 2, wherein said one or more auxiliary water passages are dimensioned to prevent foodstuff particulates or other solid contaminants in suspension in the liquid present into the first inner-volume portion of the drain sump and exceeding a given size, to enter/move into the second inner-volume portion of the drain sump.

5. Dishwashing machine according to claim 1, wherein said catchment sink assembly comprises a cup-shaped filtering body which is fitted in detachable manner into the drain sump so as to close said drain sump; said cup-shaped filtering body having a substantially dome-shaped, water-permeable upper portion, and an inner tubular segment that protrudes downwards from the dome-shaped upper portion and extends into the drain sump to form said inner tubular segment.

6. Dishwashing machine according to claim 5, wherein the dome-shaped upper portion of said cup-shaped filtering body protrudes inside catchment tank.

7. Dishwashing machine according to claim 1, wherein said catchment sink assembly (additionally comprises a strainer member which is fitted in removable manner into the main pass-through opening of said plate-like water conveyor, and is structured to hold/block the foodstuff particulates and other solid contaminants in suspension in the liquid passing/flowing through the same strainer member and exceeding a given size.

8. Dishwashing machine according to claim 7, wherein said strainer member partly protrudes underneath the plate-like water conveyor via the main pass-through opening of the same plate-like water conveyor.

9. Dishwashing machine according to claim 7, wherein said strainer member includes a basin-shaped basket having a substantially flat, water-impermeable bottom wall and one or more water-permeable sidewalls structured to hold/block the foodstuff particulates and other solid contaminants in suspension in the liquid arriving into the basket and exceeding a given size.

10. Dishwashing machine according to claim 5, wherein: a tubular element protrudes upwards from the dome-shaped upper portion of the cup-shaped filtering body so as to form a longitudinal extension of the inner tubular segment, and which additionally extends in cantilever manner inside the catchment tank towards the main pass-through opening of the plate-like water conveyor; and a top container which is located on the upper end of said tubular element, and is suitably dimensioned to close the pass-through opening of said plate-like water conveyor and optionally also accommodate the strainer member; said top container having a water-permeable structure and being dimensioned to hold/block the foodstuff particulates and other solid contaminants in suspension in the liquid arriving into the same top container and exceeding a given size; the tubular element being structured to put the inside of the top container in direct fluid communication with the inner tubular segment.

11. Dishwashing machine according to claim 10, wherein said top container is substantially basin-shaped and is dimensioned to substantially abut onto the plate-like water conveyor, all around the main pass-through opening of the plate-like water conveyor, so as to close the main pass-through opening and accommodate the strainer member.

12. Dishwashing machine according to claim 10, wherein said tubular element is coupled in detachable manner to the dome-shaped upper portion of said cup-shaped filtering body.

13. Dishwashing machine according to claim 12, wherein a lower end of said tubular element is axially fitted in manually extractable manner into a corresponding and substantially complementary-shaped, tubular seat or cavity formed in the dome-shaped upper portion of the cup-shaped filtering body, all around the upper section of the inner tubular segment.

14. Dishwashing machine according to claim 10, wherein said top container directly communicates with the adjoining tubular element via a second pass-through opening formed on a water-impermeable bottom wall of the same top container; and in that a number of protruding ribs are arranged on said bottom wall around said second pass-through opening.

* * * * *